US006206738B1

(12) United States Patent
Sugie

(10) Patent No.: US 6,206,738 B1
(45) Date of Patent: Mar. 27, 2001

(54) TERMINAL

(75) Inventor: Naoto Sugie, Shizuoka (JP)

(73) Assignee: Yazaki Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/251,150

(22) Filed: Feb. 17, 1999

(30) Foreign Application Priority Data

Feb. 20, 1998 (JP) ..... 10-039272

(51) Int. Cl.[7] ..... H01R 11/27
(52) U.S. Cl. ..... 439/852
(58) Field of Search ..... 439/852, 839, 439/842, 843, 845, 849, 858, 861, 862, 851–853

(56) References Cited

U.S. PATENT DOCUMENTS 5,281,175 * 1/1994 Chupak et al. ..... 439/852

FOREIGN PATENT DOCUMENTS 54-133392 9/1979 (JP) ..... H01R/13/12
64-16074 1/1989 (JP) ..... H01R/13/115

* cited by examiner

*Primary Examiner*—Renee Luebke
*Assistant Examiner*—Briggitte R. Hammond
(74) *Attorney, Agent, or Firm*—Sughre, Mion, Zinn, Macpeak & Seas, PLLC

(57) ABSTRACT

A terminal provided with a contact surface to be brought into contact with a mating terminal. In order to improve the strength of the contact surface, the terminal is constructed so that an elastic contact leaf is provided inside a square cylindrical contact portion into which a mating terminal is inserted and that the contact surface expanding in the direction of the elastic contact leaf is formed in a wall portion opposite to the elastic contact leaf in the contact portion. The contact surface is formed into a plane shape where the length of the central portion is set to be greater than the length of both sides in the direction of inserting the mating terminal.

2 Claims, 6 Drawing Sheets

TERMINAL

BACKGROUND OF THE INVENTION

1. Field of the Invention

The present invention relates to a box-type terminal whose contact portion which is brought into contact with a mating terminal is in a square cylindrical shape.

2. Description of the Related Art

FIG. 5 shows a conventional terminal 1 described in Japanese Utility Model Unexamined Publication No. Sho. 54-133392. In this case, a blanking press is used to form the terminal 1 out of a conductive metal sheet. The terminal 1 has a clamping portion 2 which clamp s an electric wire (not shown), a connecting portion 3 which clamps the conductor of the electric wire so as to conduct itself relative to the electric wire, and a contact portion 4 into which a mating terminal (not shown) is inserted, these portions being integrally form ed.

In the contact portion 4, side plate portions 6, 6 are extended upward from both sides of a base plate portion 5 and the upper portions of the side plate portions 6, 6 are coupled together by an upper plate portion 7 to form a square cylindrical shape. Moreover, a coupling portion 8 for coupling the upper portions of the side plate portions 6, 6 is provided on the side of the connecting portion 3. The coupling portion 8 is formed with an elastic contact leaf 9 having elasticity as it is sloped downward, and the elastic contact leaf 9 is extended downward under the upper plate portion 7 whereby to creep into the interior of the contact portion 4.

A contact surface 10 is formed by striking out the base plate portion 5 in a portion corresponding to the elastic contact portion 9 in the base plate portion 5. The contact surface 10 is stamped to a rectangular shape having a length of L1 with the whole length having a uniform width of W.

As shown in FIG. 6(*a*), a mating terminal 11 is inserted from the leading end of the contact portion 4 of the terminal 1 and when the elastic contact portion 9 presses the mating terminal 11 thus inserted against the contact surface 10, the contact surface 10 becomes conducted relative to the mating terminal 11.

When the mating terminal 11 or a jig (not shown) bumps against the contact surface 10 in the above-described terminal as shown in FIG. 6(*a*), the contact surface 10 is deformed as shown in FIG. 6(*b*) and this is problematical in that the conduction performance is impaired because of the deformation. As shown in FIG. 6(*c*), moreover, the contact surface 10 tends to bend even at the time of normal contact and consequently the conduction performance is also impaired because the bending causes the contact surface 10 not to be brought into stable contact with the mating terminal 11.

SUMMARY OF THE INVENTION

It is therefore an object of the present invention to provide a terminal which has properties making its contact surface free from deformation as well as bending and is able to secure superior conduction performance.

In order to accomplish the above object, the invention provides a terminal comprising: a square cylindrical contact portion into which a mating terminal is inserted; an elastic contact leaf provided inside the contact portion; and a contact surface expanding in a direction of the elastic contact leaf and formed in a wall portion opposite to the elastic contact leaf in the contact portion, wherein the contact surface is formed into a plane shape where a length of a central portion is set to be greater than that of both sides in a direction of inserting the mating terminal.

According to the invention, the contact surface with which the mating terminal inserted into the square cylindrical contact portion is brought into contact is arranged so that the length of its central portion is set to be greater than the length of its both sides in the direction of inserting the mating terminal. Consequently, the strength of the contact surface in the direction of inserting the mating terminal is increased. Therefore, the contact surface is never deformed. Since the whole contact surface is set to be longer in the direction of inserting the mating terminal, moreover, a contact area with respect to the mating terminal can be secured, whereby the mating terminal is brought into stable contact with the contact surface.

DETAILED DESCRIPTION OF THE PREFERRED EMBODIMENT

Figure 1:
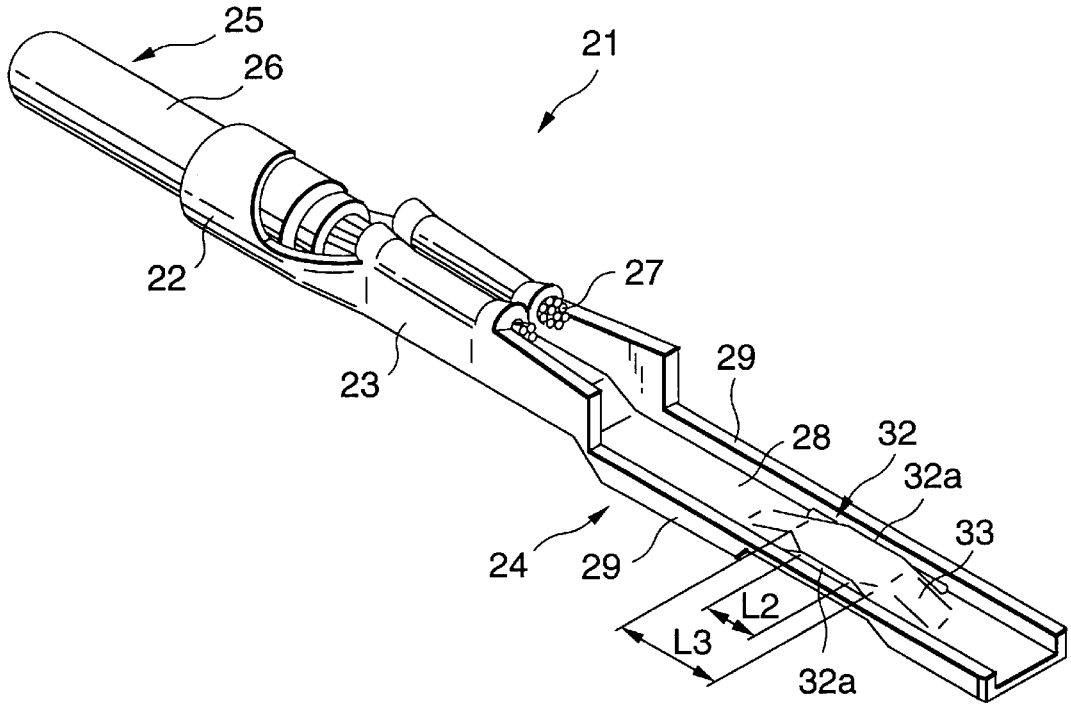
FIG. 1 is a perspective view of a terminal embodying the present invention excluding an upper plate portion.
Figure 2:
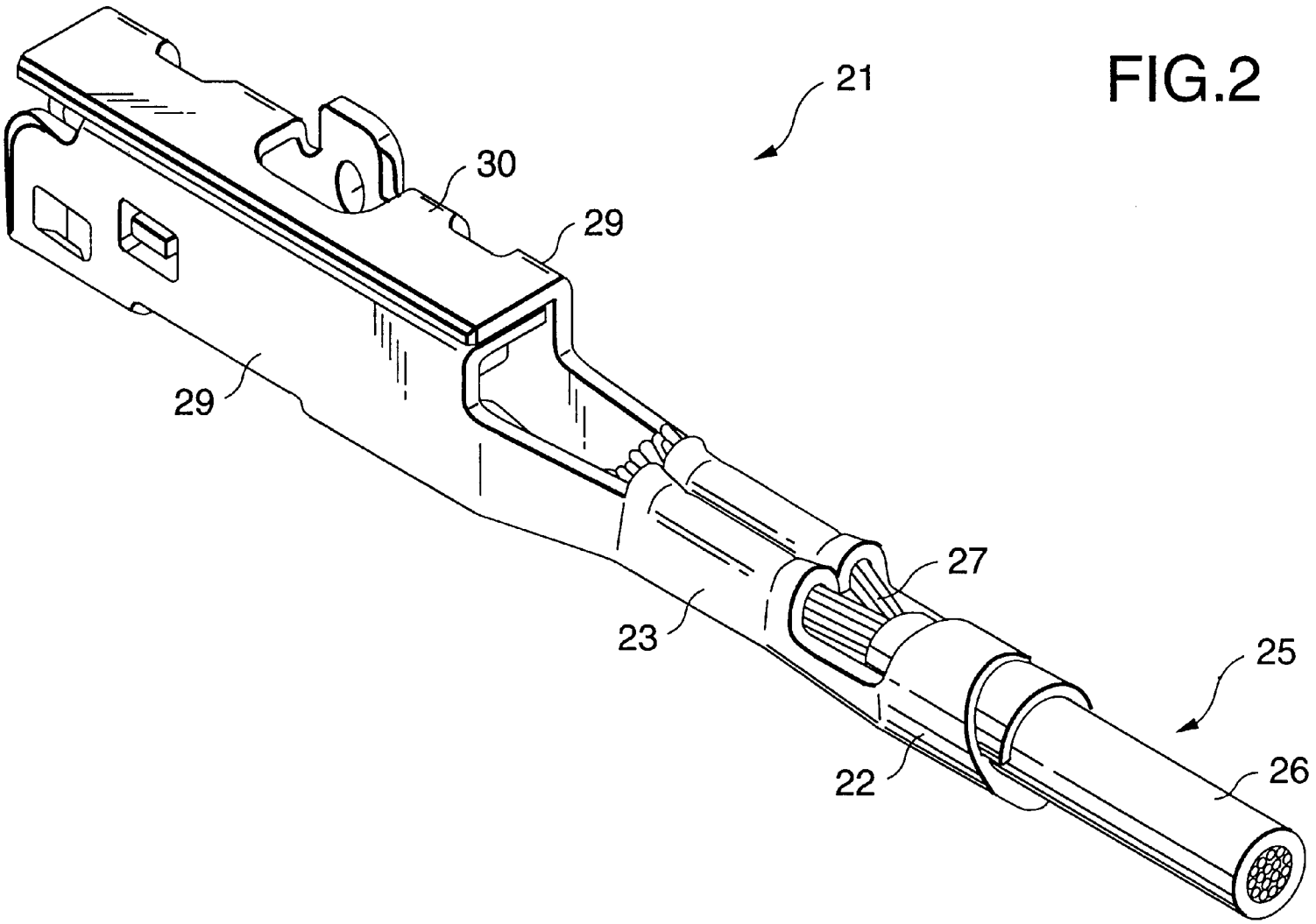
FIG. 2 is a perspective view of the terminal as a whole according to the embodiment of the invention.

FIGS. 1, 2, 3, 4(*a*) and 4(*c*) show a terminal 21 embodying the present invention. A blanking press is used to form the terminal 21 out of a conductive metal sheet and as shown in FIG. 2, the terminal 21 is furnished with a clamping portion 22, a connecting portion 23 and a contact portion 24.

Figure 6A:
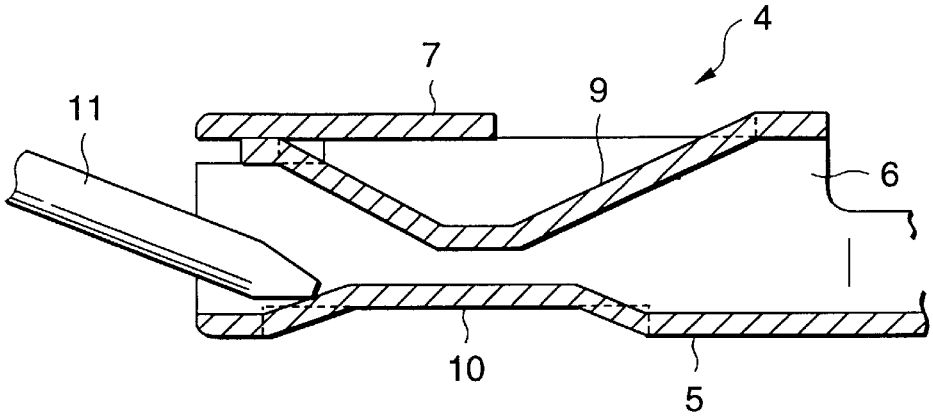
FIG.6(a) PRIOR ART
FIGS. 6(*a*), 6(*b*) and 6(*c*) are vertical sectional views explanatory of problems pertaining to the conventional terminal.
Figure 6B:
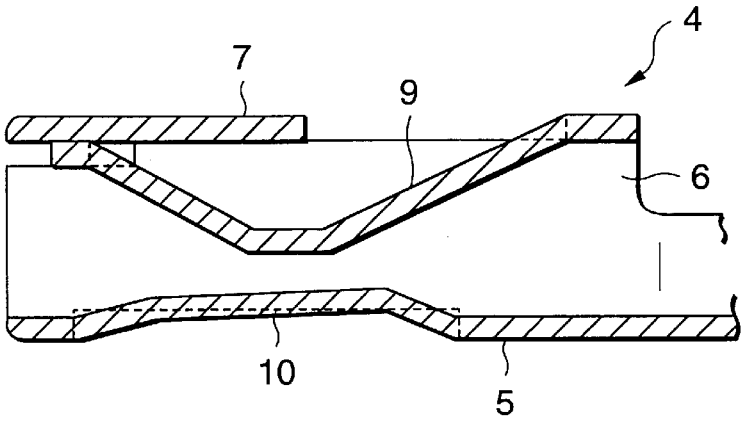
FIG.6(b) PRIOR ART
Figure 6C:
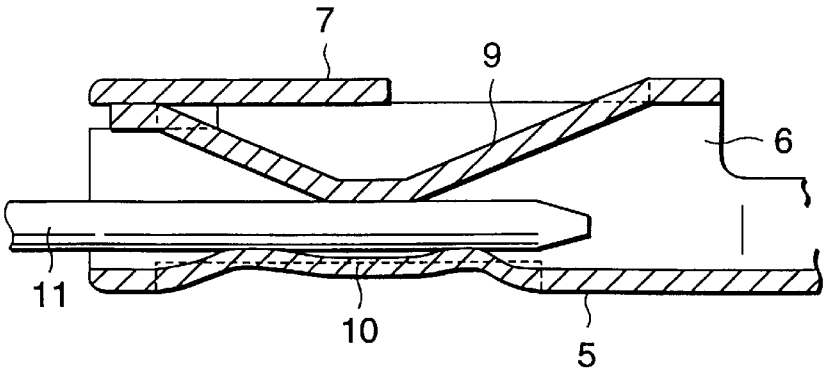
FIG.6(c) PRIOR ART

The clamping portion 22 clamps an insulating cover 26 of a n electric wire 25 in order to attach the terminal 21 to the electric wire 25. The connecting portion 23 clamps a conductor 27 exposed by peeling off the insulating cover 26 of the electric wire 25 so as to be connected to the electric wire 25. The contact portion 24 is brought into contact with a mating terminal 11 which has been inserted therein (see FIGS. 6(*a*)–6(*c*)) whereby to conduct itself relative to the mating terminal 11.

The contact portion 24 has a square cylindrical shape formed with a base plate portion 28 (see FIG. 1), lateral side plate portions 29, 29 extended upward from the base plate portion 28, and an upper plate portion 30 formed by folding and stacking the upper portions of the lateral side plate portions 29, 29 on top of each other. An elastic contact leaf 31 is provided inside the contact port ion 24.

Figure 3:
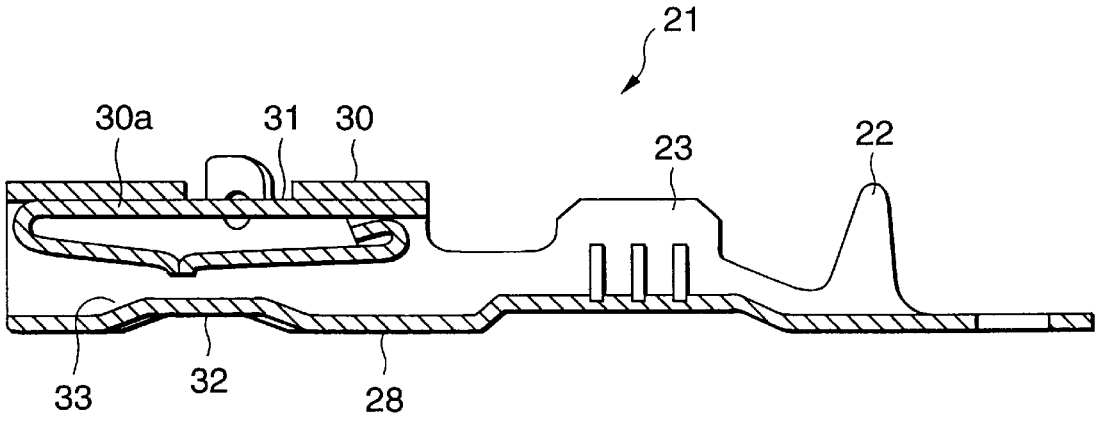
FIG. 3 is a vertical sectional view of the terminal according to the embodiment of the invention.
Figure 4A:
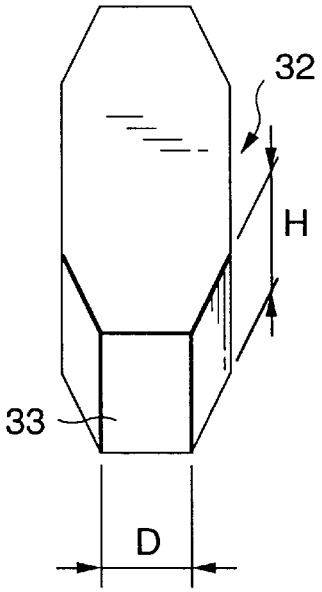
FIG. 4(*a*) is a perspective view of a contact surface in the embodiment of the invention, FIG. 4(*b*) is a perspective view of a conventional contact surface, FIG. 4(*c*) is a sectional view of the contact surface in the embodiment of the invention, and FIG. 4(*d*) is a sectional view of the conventional contact surface.
Figure 4B:
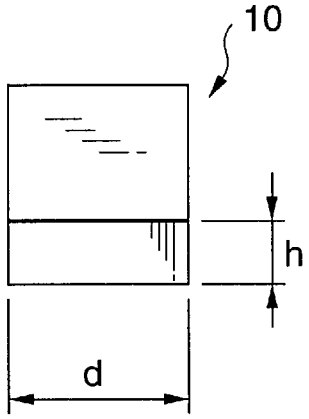
FIG.4(b) PRIOR ART
Figure 4C:
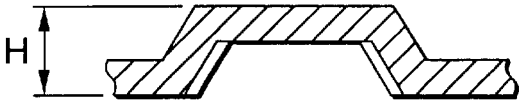
Figure 4D:
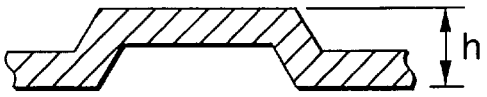
FIG.4(d) PRIOR ART

The elastic contact leaf 31 is, as shown in FIG. 3, formed by bending a lower leaf 30*a* beneath the upper plate portion 30. The leading end portion of the elastic contact leaf 31 is bent and folded back, and the folded end portion is made into a free end having elasticity. The mating terminal 11 is urged toward the base plate portion 28 be cause of the elasticity.

A contact surface 32 is formed at a portion corresponding to the elastic contact leaf 31 in the base plate portion 28. The contact surface 32 is, as shown in FIG. 1, expanded in the direction of the elastic contact leaf 31 by striking out the lower side of the base plate portion 28 upward. The contact surface 32 is formed into a polygonal shape in that its upper side is plane and long along the direction of inserting the mating terminal 11, that is, a hexagonal plane as illustrated in the drawing.

More specifically, the contact surface 32 is formed so that the length L3 of the central portion is set to be greater than the length L2 of both sides 32*a* along the direction of inserting the mating terminal 11. The contact surface 32 formed like this is of assistance to increasing the strength in the direction of inserting the mating terminal 11. Therefore, the contact surface 32 is never deformed even when the mating terminal 11 strikes thereagainst and the conduction performance can thus be secured. Since the length of the contact surface 32 as a whole is set to be greater in the direction of inserting the mating terminal 11, moreover, a contact area with respect to the mating terminal 11 can be secured, whereby the mating terminal 11 is brought into stable contact with the contact surface 32.

Figure 5:
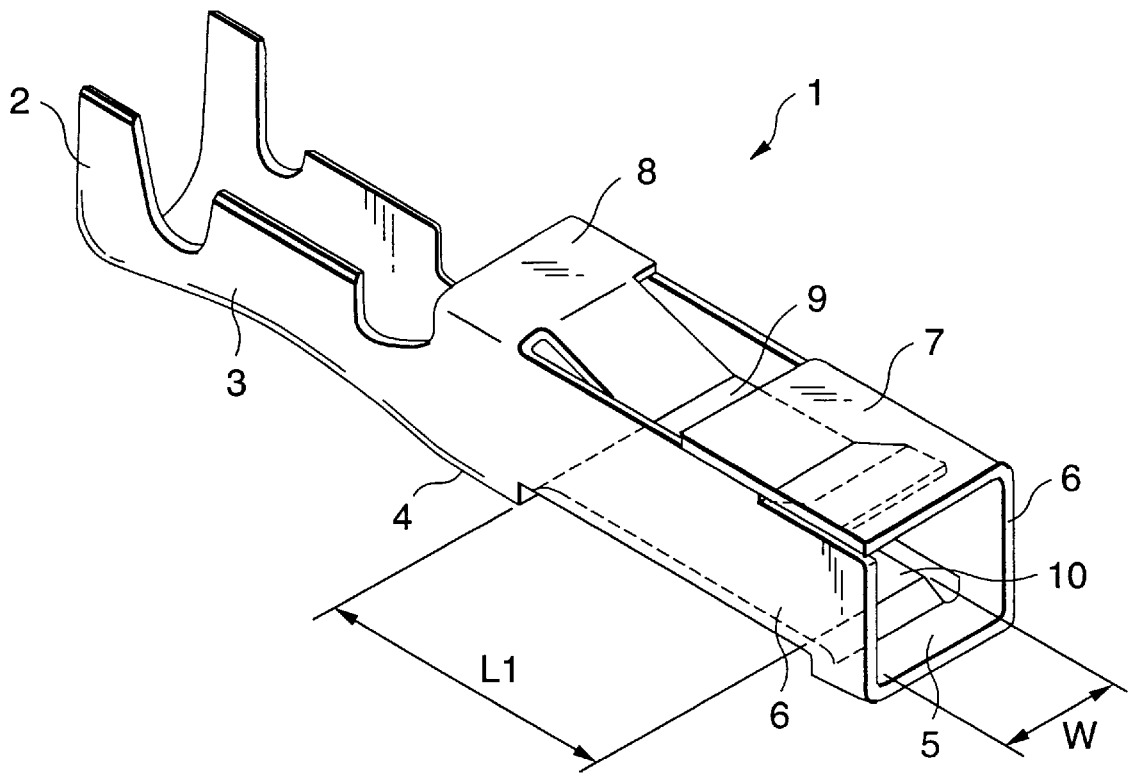
FIG.5 PRIOR ART
FIG. 5 is a perspective view of a conventional terminal.

FIGS. 4(*a*)–4(*d*) illustrate a comparison between the contact surface 32 in this embodiment of the invention and the contact surface 10 in the conventional terminal 1 shown in FIG. 5, wherein FIGS. 4(*a*) and 4(*c*) represent the contact surface 32 in this embodiment and FIGS. 4(*b*) and 4(*d*) represent the conventional contact surface 10. In the case of the contact surface 32 in this embodiment, an upright surface 33 is facing the mating terminal 11 which is inserted into the contact portion 24. With the setting of the aforesaid length relationship, the width D of the upright surface 33 is smaller than the width d of the contact surface 10 in the conventional terminal 1. Therefore, the friction of the contact surface 32 against the mating terminal 11 decreases, whereby the insertability of the mating terminal 11 is improved because the initial inserting force of the mating terminal 11 is reducible.

Since strength has been given to the contact surface 32 in this embodiment, the height H of the contact surface 32 rising from the base plate portion 28 can be set to be greater than the height h of the conventional contact surface 10. In consequence, the leading end of the mating terminal 11 is prevented from bumping against the leading end of the contact portion 24, so that the insertability of the mating terminal 11 is improved likewise.

The contact surface 32 in the present invention may be an elliptic plane whose major axis is positioned in the direction of inserting the mating terminal 11.

As described above, according to the invention, the contact surface with which the mating terminal is brought into contact is arranged so that the length of its central portion is set to be greater than the length of its both sides in the direction of inserting the mating terminal. Consequently, the strength of the contact surface in the direction of inserting the mating terminal is increased. Therefore, the contact surface is never deformed and simultaneously, the contact area with respect to the mating terminal can be secured to ensure that the mating terminal is brought into stable contact with the contact surface.

What is claimed is:

1. A terminal comprising:

a square contact portion into which a mating terminal is inserted;

an elastic contact leaf provided inside said contact portion; and a contact surface expanding in a direction of said elastic contact leaf and formed in a wall portion opposite to said elastic contact leaf in said contact portion, wherein said contact surface has a planar shape and includes a central portion and opposite lateral side portions, and wherein a length of said central portion is set to be greater than a length of said lateral side portions in a direction of inserting said mating terminal.

2. The terminal as claimed in claim 1, wherein said contact surface is polygonal in shape with a length in the direction of inserting the mating terminal being greater than that in another direction.

* * * * *